US006108859A

United States Patent [19]

Burgoon

[11] Patent Number: 6,108,859

[45] Date of Patent: Aug. 29, 2000

[54] HIGH EFFICIENCY SQUEEGEE

[75] Inventor: Jack L. Burgoon, Toledo, Ohio

[73] Assignee: Alto U. S. Inc., Chesterfield, Mo.

[21] Appl. No.: 09/124,324

[22] Filed: Jul. 29, 1998

[51] Int. Cl.[7] ..... A47L 11/30

[52] U.S. Cl. ..... 15/320; 15/340.4; 15/401

[58] Field of Search ..... 15/320, 340.4, 15/401

[56] References Cited

U.S. PATENT DOCUMENTS

| | | | |
|---|---|---|---|
| Re. 33,926 | 5/1992 | Waldhauser | 15/320 |
| 2,829,391 | 4/1958 | Swanson et al. | 15/83 |
| 3,063,082 | 11/1962 | Rosenberg | 15/327.2 |
| 3,186,021 | 6/1965 | Krier et al. | 15/340.4 |
| 3,197,798 | 8/1965 | Brown et al. | 15/320 |
| 3,206,787 | 9/1965 | Daniels et al. | 15/320 |
| 3,266,846 | 8/1966 | Luksch et al. | 299/39.9 |
| 3,550,181 | 12/1970 | Dolan et al. | 15/320 |
| 3,663,985 | 5/1972 | Burgoon | 15/353 |
| 3,702,488 | 11/1972 | Kasper | 15/50.3 |
| 3,837,029 | 9/1974 | Kasper | 15/50.3 |
| 3,872,540 | 3/1975 | Block | 15/345 |
| 3,879,789 | 4/1975 | Kasper | 15/50.3 |
| 3,939,518 | 2/1976 | Whitney et al. | 15/98 |
| 4,006,506 | 2/1977 | Burgoon | 15/50.1 |
| 4,037,289 | 7/1977 | Dojan | 15/320 |
| 4,041,567 | 8/1977 | Burgoon | 15/320 |
| 4,138,759 | 2/1979 | Voorhees | 15/245 |
| 4,158,901 | 6/1979 | Wulff et al. | 15/401 |
| 4,173,056 | 11/1979 | Geyer | 15/320 |
| 4,200,951 | 5/1980 | Burgoon et al. | 15/321 |
| 4,363,152 | 12/1982 | Karpanty | 15/98 |
| 4,492,002 | 1/1985 | Waldhauser et al. | 15/401 |
| 4,619,010 | 10/1986 | Burgoon et al. | 15/50.1 |
| 4,667,364 | 5/1987 | Meili | 15/320 |
| 4,805,256 | 2/1989 | Mason et al. | 15/320 |
| 4,817,233 | 4/1989 | Waldhauser | 15/320 |
| 5,093,955 | 3/1992 | Blehert et al. | 15/320 |
| 5,212,848 | 5/1993 | Geyer | 15/401 |
| 5,239,720 | 8/1993 | Wood et al. | 15/4 |
| 5,377,376 | 1/1995 | Wood et al. | 15/83 |
| 5,377,382 | 1/1995 | Bores et al. | 15/401 |
| 5,455,985 | 10/1995 | Hamline et al. | 15/401 |
| 5,623,743 | 4/1997 | Burgoon et al. | 15/320 |

OTHER PUBLICATIONS

Clarke–American brochure entitled "Test Drive One of the Tough Ones Clarke American: Autoscrubbers"; published prior to Jul. 29, 1998; 4 pages.

*Primary Examiner*—Terrence R. Till
*Assistant Examiner*—Theresa T. Snider
*Attorney, Agent, or Firm*—Senniger, Powers, Leavitt & Roedel

[57] ABSTRACT

A squeegee for use with a mobile surface scrubber to collect used liquid on a surface after being cleaned by the scrubber. The scrubber includes a mobile frame, a cleaning solution dispensing system mounted on the frame for wetting the surface with liquid, and at least one scrub brush attached to the frame for scrubbing the surface when wetted with liquid. In addition, the scrubber includes a vacuum system connected to the frame for removing liquid from the surface. The squeegee includes an elongate squeegee blade of flexible material having a lower edge engageable with the surface to collect the liquid on the surface for removal by the vacuum system. The squeegee also includes a series of openings through the squeegee blade extending up from the lower edge at intervals along the blade. Each opening tapers when the lower edge engages the surface to provide a relatively wide gap at the lower edge of the blade thereby permitting liquid to pass readily therethrough, and a narrower gap at an upper end of the opening having substantially no width thereby limiting passage of ambient air through the opening.

13 Claims, 5 Drawing Sheets

144
108
110
106
170
104
110
144
114
100
116

HIGH EFFICIENCY SQUEEGEE

BACKGROUND OF THE INVENTION

This invention relates generally to a mobile surface scrubber for scrubbing a surface wetted with cleaning solution, and more particularly to a high efficiency squeegee system for collecting liquid on the wetted surface.

Mobile surface scrubbers typically include a system for dispensing cleaning solution on the surface to be cleaned, scrub brushes for scrubbing the wetted surface and one or more squeegees for collecting used solution on the surface. A vacuum system is usually connected to the squeegee for removing the cleaning solution from the surface once collected. In addition, scrubbers frequently include sweeper brushes to sweep loose debris from the surface into an on-board recovery bin before the surface is wetted. The scrubbers may be used to concurrently sweep, scrub and squeegee the surface, or they may be used to perform only one or two of these functions at a time.

Conventional scrubber squeegees are arcuate so they direct liquid toward their center as they move across the surface. In order to improve the removal of liquid, conventional scrubber squeegees have two blades mounted in spaced apart relation so they form a curved chamber between them. As the scrubber moves across the surface, liquid passes under the leading blade and accumulates in the chamber. A vacuum system communicates with the chamber through a port located above the center of the chamber to draw the accumulated liquid into a holding tank and remove it from the surface.

One or more openings are provided in or beneath the leading squeegee blade to permit liquid to flow into the chamber between the blades. For instance, sometimes the leading blade is mounted so its lower edge is spaced above the surface to permit liquid to pass beneath the blade. In other instances, the leading blade has either slits or slots extending through it. Usually these openings extend up from the lower edge of the blade at intervals along the blade. Each opening has parallel sides spaced by a gap to permit liquid to flow past the blade as it wipes the surface. The gaps provided by the slits are narrow and thus do not allow an appreciable amount of liquid to flow into the chamber. The slots provide wider gaps and permit more liquid to flow past the leading blade into the chamber. However, the wider slots also allow a relatively large amount of ambient air to pass into the chamber. As larger amounts of air are allowed into the chamber, the flow rate required to be produced by the vacuum system to draw liquid out of the chamber increases. Further, the power requirements of the motor used in the vacuum system increase as the flow rate requirements increase.

SUMMARY OF THE INVENTION

Among the several objects and features of the present invention may be noted the provision of a squeegee blade which permits liquid to pass readily therethrough while limiting passage of ambient air; the provision of a squeegee which is economical to manufacture and use; and the provision of a squeegee which reduces the power required to remove liquid from a surface with an associated vacuum system.

Briefly, this invention is directed to a squeegee for use with a mobile surface scrubber to collect liquid on a surface after being cleaned by the scrubber. The scrubber comprises a mobile frame, a cleaning solution dispensing system mounted on the frame for wetting the surface with liquid, and at least one scrub brush attached to the frame for scrubbing the surface when wetted with liquid. In addition, the scrubber includes a vacuum system connected to the frame for removing liquid from the surface. The squeegee comprises an elongate squeegee blade of flexible material having a lower edge engageable with the surface to collect the liquid on the surface for removal by the vacuum system. The squeegee also includes a series of openings through the squeegee blade extending up from the lower edge at intervals along the blade. Each opening tapers when the lower edge engages the surface to provide a relatively wide gap at the lower edge of the blade thereby permitting liquid to pass readily therethrough, and a narrower gap at an upper end of the opening having substantially no width thereby limiting passage of ambient air through the opening.

In another aspect, the invention includes a squeegee assembly for use with a mobile surface scrubber as previously described. The squeegee assembly comprises leading and trailing elongate squeegee blades of flexible material. Each blade has a lower edge engageable with the surface to collect liquid on the surface for removal by the vacuum system. In addition, the squeegee assembly includes a mount for mounting the leading and trailing squeegee blades to the scrubber frame in spaced apart relation to define a chamber therebetween for accumulating liquid collected by the squeegee blades. The chamber communicates with the vacuum system for removing accumulated liquid from the chamber. The leading blade includes a series of openings substantially as described above. The relatively wide gap at the lower edge of the leading blade permits liquid to pass readily therethrough into the chamber. The narrower gap at an upper end of the opening limits passage of ambient air into the chamber.

In yet another aspect, the present invention includes a mobile surface scrubber for cleaning a surface with liquid. The scrubber comprises a mobile frame, a cleaning solution dispensing system mounted on the frame for wetting the surface with liquid and at least one scrub brush attached to the frame for scrubbing the surface when wetted with liquid. The scrubber also includes a vacuum system connected to the frame for removing liquid from the surface. Further, the scrubber includes leading and trailing squeegee blades substantially as described above.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
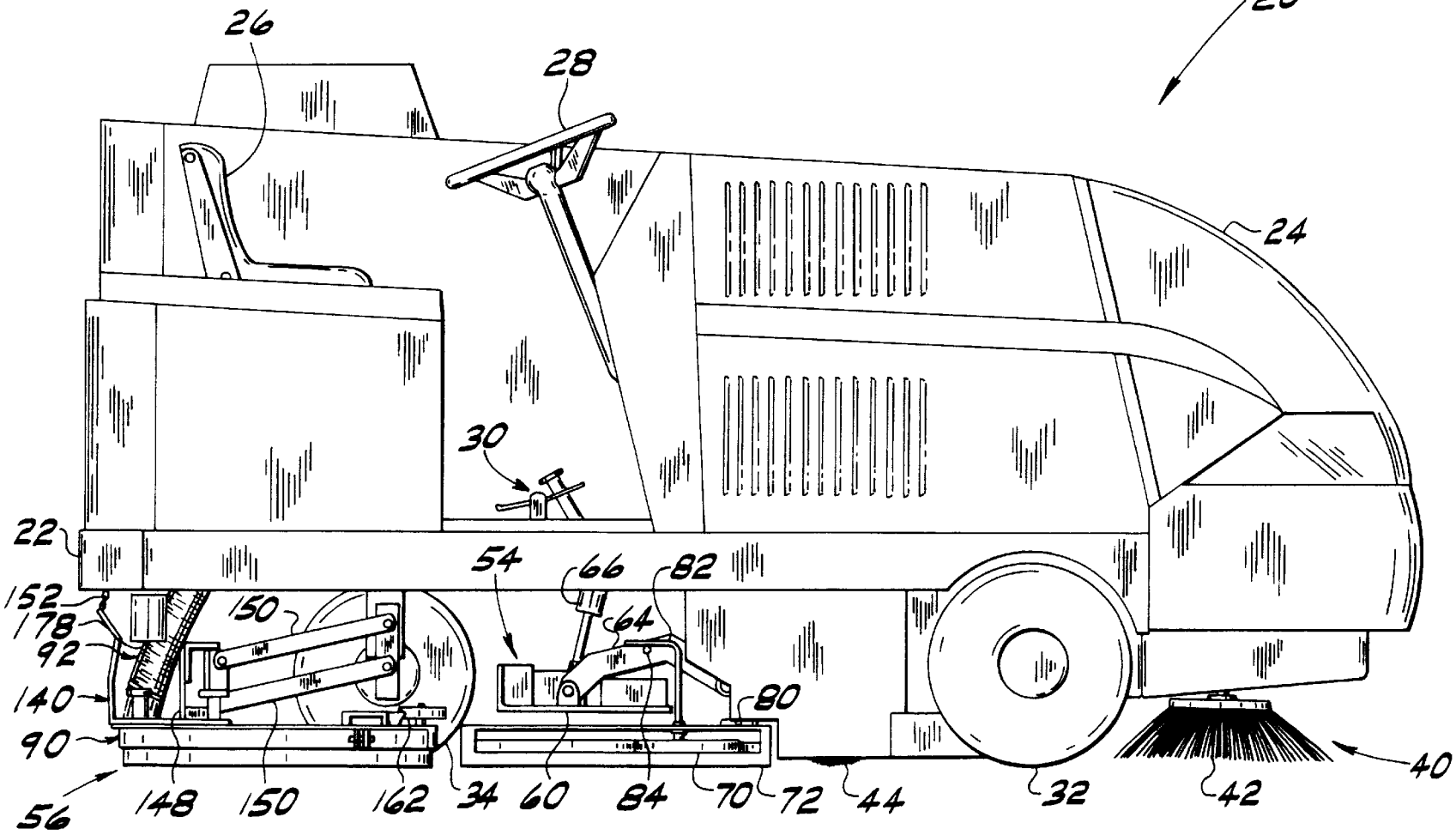
FIG. 1 is a side elevation of a mobile surface scrubber incorporating a squeegee assembly of the present invention.

Referring now to the drawings, FIG. 1 illustrates a mobile surface scrubber, indicated generally at 20, of the type used to sweep, scrub and/or squeegee a surface such as a warehouse or factory floor or a parking lot. The scrubber 20 has a frame 22 supporting a body 24 which houses various scrubber components. A seat 26 mounted on the body 24 permits an operator to ride on the scrubber 20. Hand operated controls 28 and foot operated controls, generally indicated at 30, are positioned in front of the seat 24 so the operator may access them when seated to control the scrubber 20 operation. Two front wheels 32 (only one of which is visible in FIG. 1) and one rear wheel 34 are mounted on the frame 22. The rear wheel 34 is driven by an motor 36 (FIG. 2) to propel the scrubber over the surface. The rear wheel 34 is pivotable about a vertical axis so the scrubber 20 may be turned to travel to the left or right.

Figure 2:
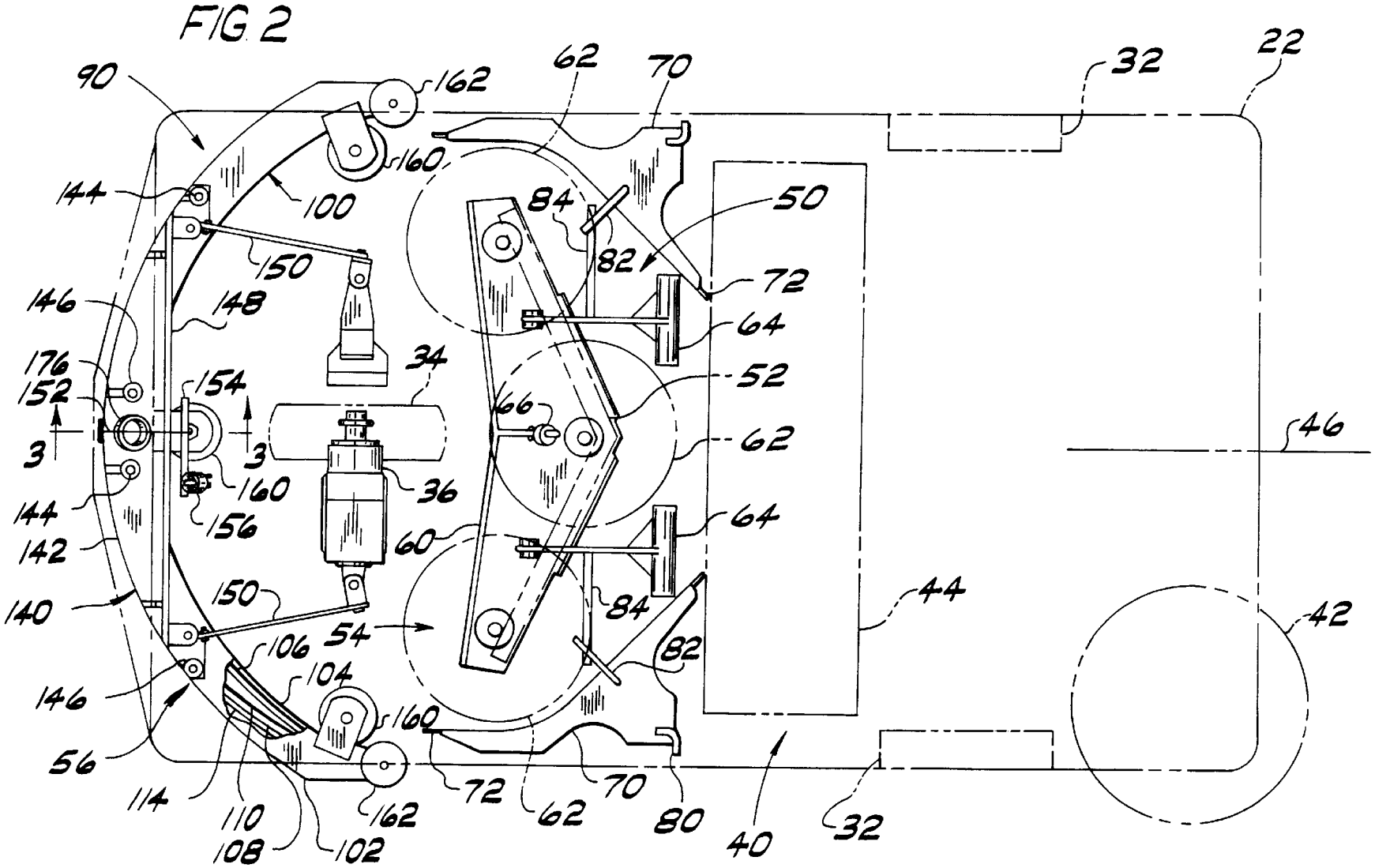
FIG. 2 is a top plan of the squeegee assembly of FIG. 1 shown in relation to a scrubber which is partially shown in phantom.

The scrubber 20 is equipped with a sweeper system, generally indicated at 40 in FIG. 2, which includes sweeper brushes or brooms 42, 44 and a vacuum (not shown) for removing loose debris. The forward broom 42 is a rotary disk, curb broom which is rotatably mounted on the frame 22 at its front right corner. The curb broom 42 rotates counterclockwise (as viewed from the top) about a vertical axis to sweep debris toward the central longitudinal axis or centerline 46 (FIG. 2) of the scrubber 20. As its name implies, the curb broom 42 is particularly useful for sweeping debris away from curbs, walls and other fixed obstructions. The rearward broom 44 is a rotary cylindrical, main broom positioned behind the front wheels 32. The broom 44 rotates counterclockwise (as viewed in FIG. 1) about an horizontal axis to sweep debris forward and upward into a collection bin (not shown) mounted on the frame 22 above and in front of the front wheels 32. A vacuum filtration system (not shown) retains the debris in the bin and prevents dust from escaping into the surrounding environment. The previously described aspects of the scrubber 20 and sweeper system 40 are conventional and will not be described in further detail.

As further illustrated in FIG. 2, the scrubber system, indicated generally at 50, comprises a cleaning solution dispensing system 52, a scrub brush assembly (generally designated by 54), and a solution recovery system (generally designated by 56). As is conventional in the art, the solution dispensing system 52 includes a solution storage tank (not shown) and nozzles (not shown) connected to the tank for dispensing cleaning solution from the tank to the surface in the vicinity of the scrub brush assembly 54.

The scrub brush assembly 54 includes a chevron-shaped deck 60 secured to the frame 22, and three rotary disk scrub brushes 62 rotatably mounted on the deck. Each of the brushes 62 bears down on the surface and rotates about a vertical axis to scrub the surface when wetted with cleaning solution. The deck 60 is connected to the frame 22 by two links 64 which are pivotally connected to both the frame and the deck. An hydraulic actuator 66 connected between the frame 22 and deck 60 permits the deck to be raised and lowered. Side squeegees 70 are mounted outboard from the scrub brush assembly 54. Each side squeegee 70 includes a blade 72 which wipes the surface to keep the dispensed cleaning solution between the side squeegees and beneath the scrubber 20. The side squeegees 70 are mounted on the frame 22 so they do not pivot substantially with respect to the scrubber 20 as it turns left or right. However, each side squeegee 70 includes a horizontal axle 80 connected to the frame 22 so the squeegee can pivot upward away from the surface to ride over obstacles and follow the contour of the surface being scrubbed. Each side squeegee 70 also includes an arm 82 which engages a bar 84 extending from the corresponding link 64 supporting the scrub brush assembly 54 so the side squeegees raise when the scrub brush assembly is lifted by the hydraulic cylinder 66.

The solution recovery system 56 includes a pivotally-mounted, arcuate, rear squeegee assembly, generally designated by 90, for collecting liquid such as used cleaning solution and a vacuum system, generally designated by 92 (partially shown in FIG. 1) for removing the collected liquid from the surface.

Figure 3:
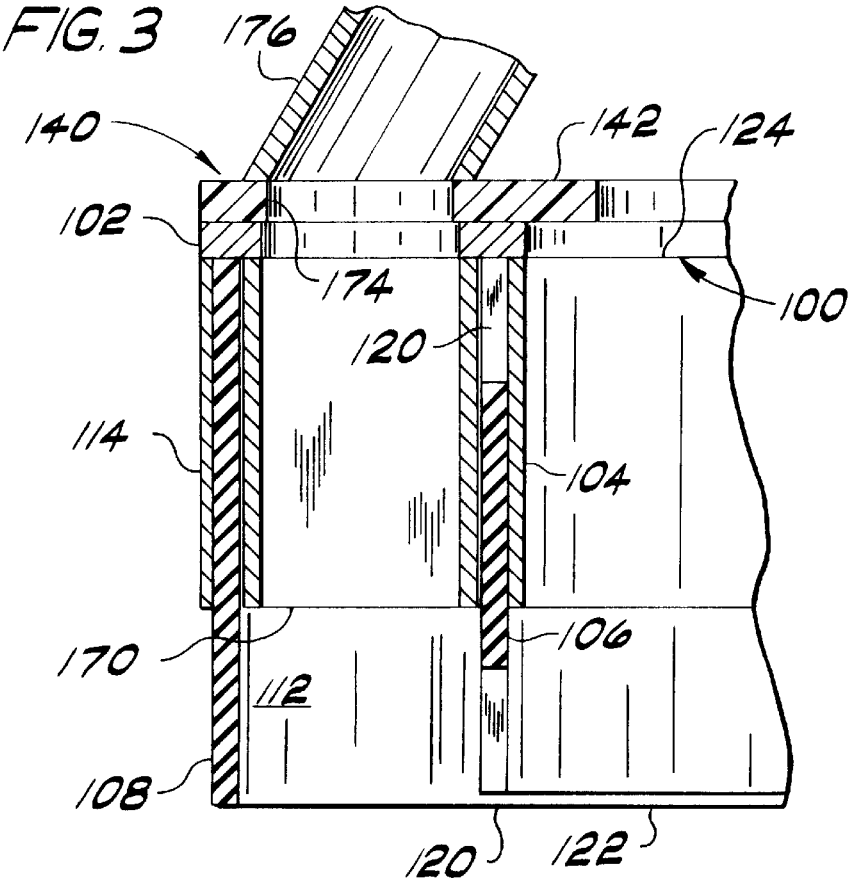
FIG. 3 is a cross section of the squeegee assembly taken in the plane of line 3—3 of FIG. 2.
Figure 5:
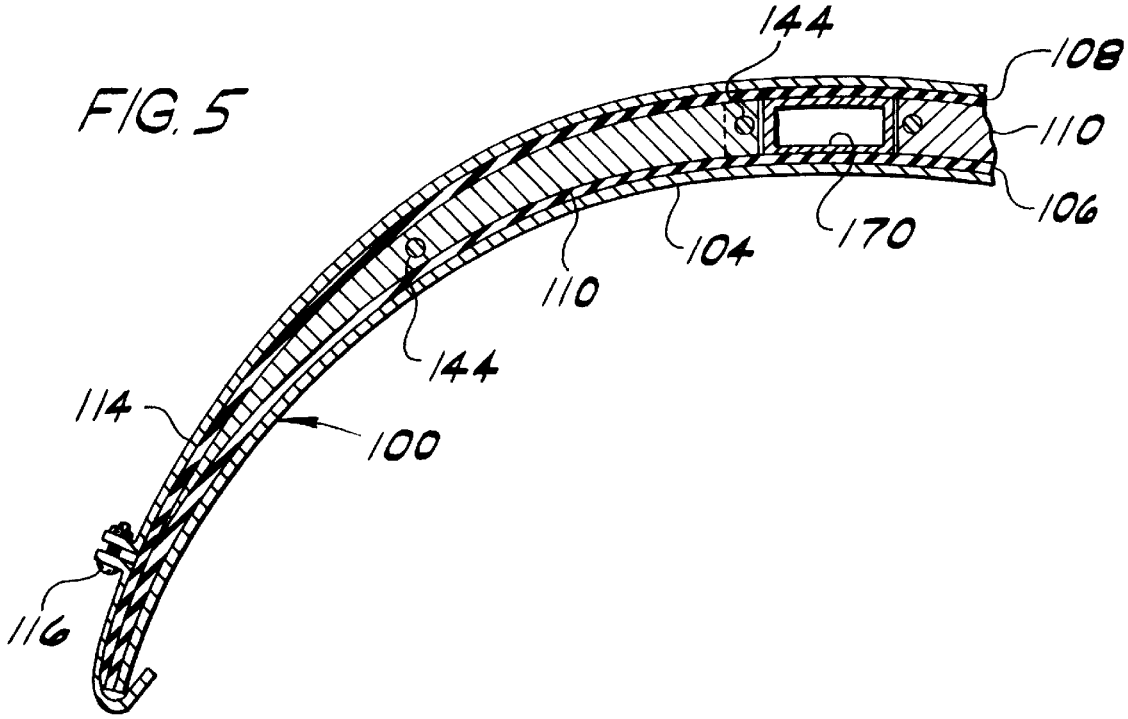
FIG. 5 is a cross section of the squeegee assembly taken in the plane of line 5—5 of FIG. 4.

Referring to FIGS. 2, 3 and 5, the squeegee assembly 90 includes an arcuate blade support, generally designated 100, having a horizontal top 102 and a vertical wall 104 extending down from a forward edge of the top and generally transversely with respect to the scrubber centerline 46. Leading and trailing blades 106, 108, respectively, are mounted behind the wall 104 of the blade support 100 for collecting liquid as will be explained in further detail below. As shown in FIG. 5, tapered arcuate spacers 110 are positioned between the leading and trailing blades 106, 108 to space the blades and thereby form a chamber 112 (FIG. 3) between the blades for accumulating liquid collected by the squeegee. An adjustable arcuate clamp 114 hooks around the ends of the vertical wall 104 of the blade support 100 to hold the blades 106, 108 and the spacers 110 tightly in place in the squeegee assembly 90. Screw fasteners 116 provided near opposite ends of the clamp 114 permit the length of the clamp to be adjusted to vary how tightly the clamp holds the blades 106, 108 and spacers 110 in place. As will be understood by those skilled in the art, the clamp 114 attaches the blades 106, 108 to the blade support 100 so they bend or flex to conform to the surface being wiped.

The squeegee blades of the preferred embodiment are made of flexible materials. Although the squeegee blades may be made of other materials without departing from the scope of the present invention, the leading blade 106 of the preferred embodiment is made of urethane having a Shore A durometer hardness of between about 75 and about 95 and the trailing blade 108 of the preferred embodiment is made of gum rubber having a Shore A durometer hardness of between about 35 and about 45. Further, although the blades may have other dimensions without departing from the scope of the preferred embodiment, the leading blade 106 is approximately 3.25 inches tall, approximately 0.13 inches thick and approximately 70.0 inches long and the trailing blade 108 is approximately 3.31 inches tall, approximately 0.25 inches thick and approximately 72.88 inches long.

Figure 7:
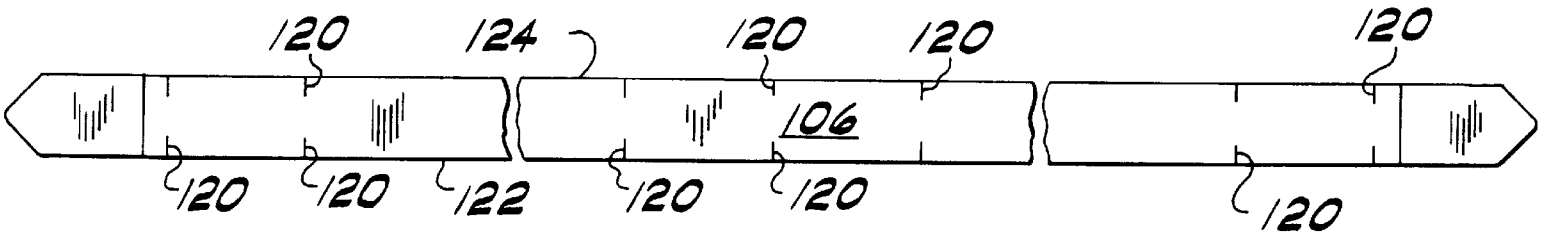
FIG. 7 is a front elevation of a squeegee of the present invention.

As shown in FIG. 7, the leading blade 106 has a series of slits 120 through the blade extending up from its lower edge 122 at intervals along the blade for permitting liquid to pass the leading blade and accumulate in the chamber 112. The trailing blade 108 does not have slits. Although the slits 120 in the leading blade 106 may have other lengths without departing from the scope of the present invention, the slits of the preferred embodiment are between about 0.7 and about 0.9 inches long. Although fewer or more slits may be used without departing from the scope of the present invention, the leading blade 106 of the preferred embodiment has 21 slits spaced at about three inch intervals along the blade. Moreover, as shown in FIG. 7, slits 120 are provided in the leading blade 106 along its upper edge 124 as well as its lower edge 122 so the blade can be inverted for continued use after the lower edge becomes worn.

Figure 6:
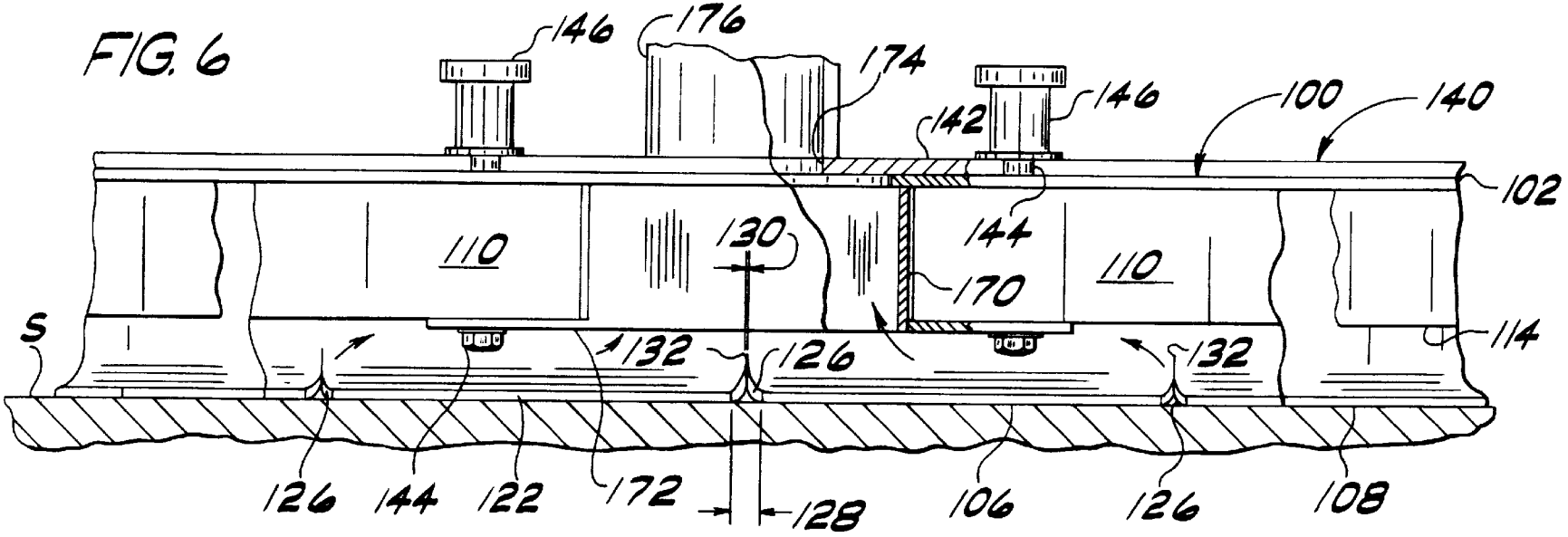
FIG. 6 is a rear elevation of the squeegee assembly in partial section.

As illustrated in FIG. 6, the slits 120 in the leading blade 106 form tapered openings 126 when the lower edge 122 of the blade engages the surface S and deflect as the scrubber moves along the surface. The openings 126 have a relatively wide gap 128 at the lower edge 122 of the blade 106 which permits liquid to pass readily through the blade into the chamber 112. Each opening 126 has a narrow gap 130 at its upper end 132 to limit passage of ambient air into the chamber 112. Although the openings may have other configurations without departing from the scope of the present invention, each generally V-shaped opening 126 of the preferred embodiment tapers substantially uniformly from the lower edge 122 of the blade 106 up to the upper end 132 of the opening. Further, in the most preferred embodiment, the narrow gaps 130 at the upper end 132 of the openings 126 have substantially no width because the slits 120 are formed by cuts in the blade 106 having kerfs of substantially no width. Thus, liquid collected by the squeegee assembly 90 passes readily through the leading blade 106 into the chamber 112, but ambient air flow into the chamber is restricted. Although the leading and trailing blades 106, 108, respectively, of the preferred embodiment are continuous and one piece, it is envisioned that they may be divided into two or more lengths in an alternate embodiment.

Figure 4:
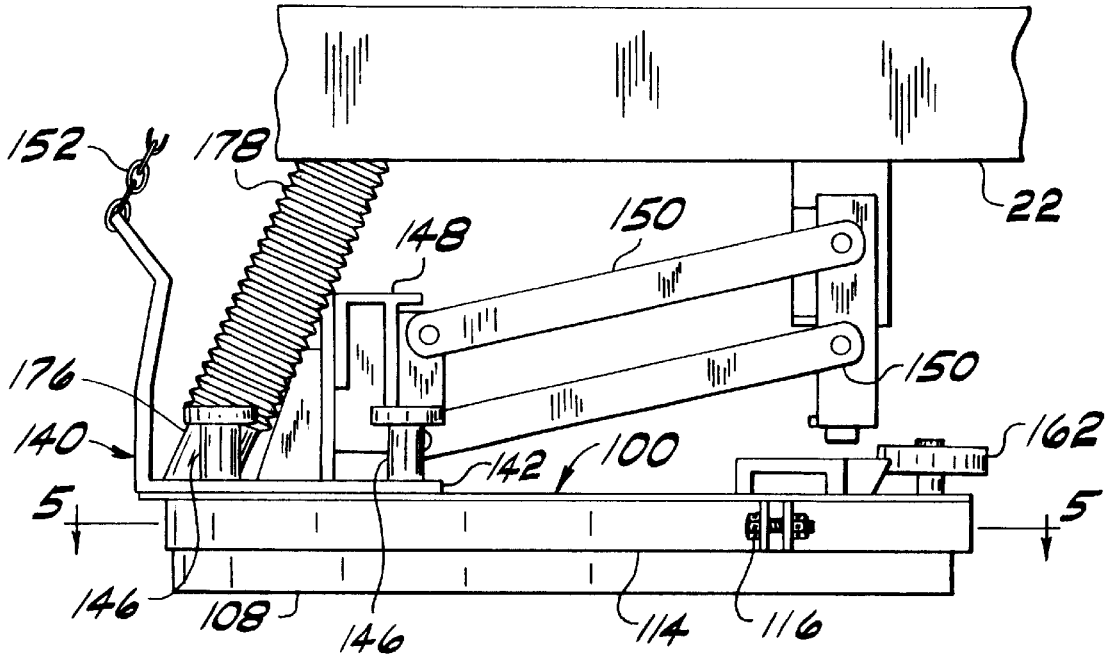
FIG. 4 is a side elevation of the squeegee assembly.

As illustrated in FIGS. 2 and 4, a mount, generally designated 140, is pivotally connected to the scrubber frame 22 for mounting the squeegee assembly 90 on the scrubber 20. The mount 140 comprises a connector plate 142 which engages the squeegee assembly 90 when connecting the assembly to the mount. As shown in FIG. 6, bolts 144 extend up through the arcuate spacers 110 in the squeegee assembly 90 for fastening the assembly to the mount 140. Large nuts 146 threaded on the bolts 144 releasably fasten the squeegee assembly 90 to the connector plate 142. These nuts 146 may be manually turned to remove and replace the squeegee assembly 90 without tools when the blades 106, 108 are worn or the squeegee needs other maintenance.

As further illustrated in FIGS. 2 and 4, a bracket 148 extends up from the connector plate 142. This bracket 148 is pivotally connected to two pairs of parallel links 150 which are pivotally connected to the scrubber frame 22. The links 150 pivot about vertical and horizontal axes with respect to the frame 22 and the plate 142 to permit the rear squeegee 90 to rise and fall to ride over obstructions. However, because the two links 150 of each pair are parallel, the squeegee assembly 90 remains generally parallel to the frame 22 as it rises and falls so the squeegee blades 106, 108 ideally contact the surface over their entire respective lengths. Further, the links 150 permit the squeegee assembly 90 to move from side to side with respect to the frame 22. Since the forward ends of the pairs of links 150 are more closely spaced than the rearward ends, the linkage forces the squeegee assembly 90 to turn as it moves from side to side so the concave side of the squeegee assembly is always directed toward the scrub brushes 62.

As illustrated in FIG. 2, a chain 152 connects the squeegee assembly 90 to a pivotable lever 154 mounted on the frame 22. An actuator 156 is mounted on the frame 22 for pivoting the lever 154 to raise and lower the squeegee assembly 90 as needed. The flexibility of the chain 152 also permits the squeegee assembly 90 to rise and fall to pass over obstructions and to swing from side to side during turns. Three casters 160 mounted along the squeegee assembly 90 support the assembly so the blades 106, 108 wipe against the surface S being cleaned. A roller 162 is mounted on each end of the squeegee assembly 90 for rotation about a vertical axis for fending the assembly off walls and other obstructions to prevent damage to the assembly and the obstructions.

As shown in FIGS. 5 and 6, a generally rectangular tube 170 positioned between the arcuate spacers 110 generally at the center of the squeegee assembly 90 provides a passage through the assembly for providing communication between the chamber 112 and the vacuum system 92. The tube 170 has a flange 172 extending from each side (FIG. 6) for connecting the tube to the squeegee assembly 90 using the bolts 144. An opening 174 in the connector plate 142 of the mount 140 provides a passage through the mount, and a short connecting sleeve 176 extending up from the connector plate 142 above the opening 174 connects the chamber 112 to a vacuum hose 178 of the vacuum system 92 as shown in FIG. 4. Thus, the chamber 112 communicates with the vacuum system 92 for removing accumulated liquid from the chamber.

The previously described squeegee assembly 90 and vacuum system 92 form the solution recovery system 56 which collects and removes virtually all of the liquid from the surface S. In fact, the previously described recovery system has been found to remove between about 95 and about 98 percent of the liquid from the surface. Further, because the openings 126 restrict the amount of ambient air entering the chamber 112, the flow rate requirement of the vacuum system 92 is significantly reduced. For example, the vacuum system 92 of the preferred embodiment is capable of removing fluid (i.e., air and solution) from the chamber 112 at a rate of about 150 cubic feet per minute. When prior art squeegees having wide slots rather than the tapered slits were used, a vacuum system capable of removing fluid at a rate of about 400 cubic feet per minute was needed because significantly more air entered the chamber 112. Further, a 1.5 horsepower motor drives the vacuum system 92 of the preferred embodiment. When the prior art slotted squeegees were used, a five horsepower motor was required.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A squeegee for use with a mobile surface scrubber to collect liquid on a surface after being cleaned by the scrubber, said scrubber comprising a mobile frame, a cleaning solution dispensing system mounted on the frame for wetting the surface with liquid, at least one scrub brush attached to the frame for scrubbing the surface when wetted with liquid, and a vacuum system connected to the frame for removing used liquid from the surface, said squeegee comprising:

an elongate squeegee blade of flexible material having a lower edge engageable with said surface to collect liquid on the surface for removal by the vacuum system; and a series of openings through the squeegee blade extending up from its lower edge at intervals along the blade, each opening tapering when the lower edge engages the surface to provide a relatively wide gap at the lower edge of the blade thereby permitting liquid to pass readily therethrough, and a narrower gap at an upper end of the opening having substantially no width thereby limiting passage of ambient air through the opening.

2. A squeegee as set forth in claim 1 wherein the openings in said squeegee blade are formed by slits in the blade, and wherein the blade is adapted to deflect as it engages the surface to open the slits thereby forming said relatively wide gaps at the lower edge of the blade.

3. A squeegee as set forth in claim 2 wherein each opening tapers substantially uniformly from said lower edge of the blade up to said upper end of the opening.

4. A squeegee as set forth in claim 3 wherein each slit is defined by a cut having a kerf of substantially no width.

5. A squeegee as set forth in claim 4 wherein the blade has an upper edge opposite said lower edge and the squeegee further comprises a series of slits through the squeegee blade extending down from the upper edge at intervals along the blade so the blade is invertible.

6. A squeegee assembly for use with a mobile surface scrubber to collect liquid on a surface after being cleaned by the scrubber, said scrubber comprising a mobile frame, a cleaning solution dispensing system mounted on the frame for wetting the surface with liquid, at least one scrub brush attached to the frame for scrubbing the surface when wetted with liquid, and a vacuum system connected to the frame for removing liquid from the surface, said squeegee assembly comprising:

leading and trailing elongate squeegee blades of flexible material, each blade having a lower edge engageable with said surface to collect liquid on the surface for removal by the vacuum system;

a mount for mounting the leading and trailing squeegee blades to the scrubber frame in spaced apart relation to define a chamber therebetween for accumulating liquid collected by the squeegee blades, the chamber communicating with the vacuum system for removing accumulated liquid from the chamber; and a series of openings through the leading squeegee blade extending up from its lower edge at intervals along the blade, each opening tapering when the lower edge engages the surface to provide a relatively wide gap at the lower edge of the blade thereby permitting liquid to pass readily therethrough into said chamber, and a narrower gap at an upper end of the opening having substantially no width thereby limiting passage of ambient air into said chamber.

7. A squeegee assembly as set forth in claim 6 wherein the openings in said leading squeegee blade are formed by slits in the blade, and wherein the leading blade is mounted so as to permit the blade to deflect as it engages the surface to open the slits thereby forming said relatively wide gaps at the lower edge of the blade.

8. A squeegee assembly as set forth in claim 7 wherein each opening tapers substantially uniformly from said lower edge of the leading blade up to said upper end of the opening.

9. A squeegee assembly as set forth in claim 8 wherein each slit is defined by a cut having a kerf of substantially no width.

10. A squeegee assembly as set forth in claim 9 wherein said mount comprises an arcuate blade support extending generally transversely with respect to the scrubber, the support holding the blade so as to permit the blade to deflect to conform to the surface.

11. A mobile surface scrubber for cleaning a surface with liquid, said scrubber comprising:

a mobile frame;

a cleaning solution dispensing system mounted on the frame for wetting the surface with liquid;

at least one scrub brush attached to the frame for scrubbing the surface when wetted with liquid;

a vacuum system connected to the frame for removing liquid from the surface;

leading and trailing elongate squeegee blades of flexible material mounted on the frame, each blade having a lower edge engageable with said surface to collect liquid on the surface for removal by the vacuum system, the leading and trailing squeegee blades being mounted on the frame in spaced apart relation to define a chamber therebetween for accumulating liquid collected by the squeegee blades, the chamber communicating with the vacuum system for removing accumulated liquid from the chamber; and a series of openings through the leading squeegee blade extending up from the lower edge at intervals along the blade, each opening tapering when the lower edge engages the surface to provide a relatively wide gap at the lower edge of the blade thereby permitting liquid to pass readily therethrough into said chamber, and a narrower gap at an upper end of the opening having substantially no width thereby limiting passage of ambient air into said chamber.

12. A scrubber as set forth in claim 11 further comprising a mount for mounting the leading and trailing squeegee blades to the scrubber frame.

13. A scrubber as set forth in claim 12 wherein said mount comprises an arcuate blade support extending generally transversely with respect to the scrubber, the support holding the blade so as to permit the blade to deflect to conform to the surface.

* * * * *